US006206587B1

(12) United States Patent
Ikeda et al.

(10) Patent No.: US 6,206,587 B1
(45) Date of Patent: Mar. 27, 2001

(54) AUTOMATIC PROCESSING MACHINE AND METHOD FOR MANUFACTURING CONVEYING ROLLERS USED THEREIN

(75) Inventors: Jun Ikeda; Yutaka Mizuma; Kenji Inoue, all of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/406,805

(22) Filed: Sep. 28, 1999

(30) Foreign Application Priority Data

Sep. 30, 1998 (JP) ..... 10-277803

(51) Int. Cl.[7] ..... G03D 3/08

(52) U.S. Cl. ..... 396/612; 396/617; 396/619; 396/620

(58) Field of Search ..... 396/612, 617, 396/620, 626; 492/56; 355/27–29

(56) References Cited

U.S. PATENT DOCUMENTS 5,708,903 * 1/1998 Kashino et al. ..... 396/622
5,753,396 * 5/1998 Nakamura et al. ..... 430/101
5,832,329 * 11/1998 Nemoto et al. ..... 396/612

* cited by examiner

*Primary Examiner*—D. Rutledge
(74) *Attorney, Agent, or Firm*—Sughrue, Mion, Zinn, Macpeak & Seas, PLLC

(57) ABSTRACT

There is provided an automatic processing machine which comprises a processing-solution processing section in which a photographic photosensitive material is subjected to development processing, and a drying section for drying the photeosensitive material processed in the processing-solution processing section, particularly, an automatic processing machine in which an upper roller of conveying rollers or squeeze rollers, which are disposed at an upstream side of the drying section, is formed so that a contact angle of a water drop on a peripheral surface thereof is less than 135°, preferably 125°. The upper roller of silicone rubber in the conveying rollers or in the squeeze rollers includes a peripheral surface coated with a gelatin film. By conducting cross-linking using silicon for a long duration at the time of manufacturing silicone rubber, water repellency of the surface (that is, surface tension) is restrained and the contact angle of a water drop is thereby set to be less than 135°. Accordingly, the water drop does not remain spherical on the upper roller and is apt to be made flat. Namely, water is uniformly dispersed over the entire surface region of the upper roller and the formation of spot marks can be prevented.

16 Claims, 4 Drawing Sheets

AUTOMATIC PROCESSING MACHINE AND METHOD FOR MANUFACTURING CONVEYING ROLLERS USED THEREIN

BACKGROUND OF THE INVENTION

1.Field of the Invention

The present invention relates to an automatic processing machine in which an exposed photosensitive material is subjected to development processing by being sequentially immersed in a developing solution, a fixing solution, and washing water while being nipped and conveyed by a plurality of conveying rollers, and thereafter, the processed photosensitive material is dried in a drying section, and also relates to a method for manufacturing the conveying rollers used in the automatic processing machine.

2.Description of the Related Art

In an automatic processing machine, an exposed photographic photosensitive material (hereinafter referred to simply as a photosensitive material) is subjected to development processing by being conveyed in such a manner as to be sequentially immersed in a developing solution, a fixing solution, and washing water. The photosensitive material having been conveyed through the washing water is dried in a drying section and is discharged from the automatic processing machine.

Here, squeeze rollers are disposed in a crossover portion between adjacent processing tanks in which processing solutions are respectively filled, so as to decrease the amount of processing solutions applied to the photosensitive material in an upstream processing tank and further transferred to a downstream processing tank. Further, squeeze rollers are disposed at the downstream side of a washing tank and are adapted to squeeze out water on the photosensitive material before the photosensitive material is transferred to the drying section.

It is observed that dotted or streaked marks are sometimes formed on the photosensitive material discharged from the automatic processing machine. When such marks are formed on an X-ray film, particularly, there is a possibility that a diagnosis which demands high precision can be interfered. As a result of examining the cause by which such marks or stains occur, it was confirmed that squeeze rollers have a role in causing such marks.

In such conventional squeeze rollers, as is well known, a soft silicon roller having a high water repellency and a hard phenol roller opposed thereto are used.

The water squeezed out by the squeeze rollers may remain between these rollers.

Since the photosensitive material passes through a fixing solution in the development process, fixing components contained in the fixing solution (that is, thiosulfate and the like) are inevitably mixed in the remaining water. The fixing components are dried and concentrated by drying air leaked from the drying section disposed on the downstream side of the squeeze rollers, and remain as spots on the squeeze rollers. As a result, when water is squeezed out from the next conveyed photosensitive material, spot marks are transferred to the material which affect adversely the finished state of an image subjected to development processing.

As measures against the aforementioned, there is a method in which the squeeze rollers are caused to run idle at a predetermined timing to disperse water over the entire surface of the rollers so that water containing fixing components does not remain between the squeeze rollers. However, this method cannot completely prevent the occurrence of the spot marks.

The above-described phenomenon is noticeably seen when relatively new rollers are used, that is, when an almost new automatic processing machine is used, or when rollers are replaced with new ones.

Generally, a silicon roller used as one of the squeeze rollers in an automatic processing machine has a high water repellency, and even if such squeeze rollers are caused to run idle, the surface tension of a water drop keeps the water drop as it is without being dispersed over the entire surface of the one roller, thereby causing formation of spot marks. Accordingly, occurrence of spot marks may be prevented by making the contact angle of a water drop on the roller of the squeeze rollers smaller.

In order for the water to be dispersed on the roller, it suffices that a roller having a high water absorbing ability be employed. However, a roller having a water absorbing surface tends to be contaminated with the passage of time, and therefore, maintenance becomes complicated.

Further, the present inventors have further examined the cause of formation of spot marks, and as a result, they have found that spot marks are formed probably because low molecular weight silicon present in a silicone rubber polymer which is a main component of a silicone rubber roller used as one of the squeeze rollers, volatilizes toward the peripheral surface of the roller and is transferred to the photosensitive material in contact with the squeeze rollers, to thereby cause a the sensitization on the photosensitive material in which the transferred silicon serves as a core thereof.

SUMMARY OF THE INVENTION

In view of the above-described circumstances, it is an object of the present invention to provide an automatic processing machine equipped with a squeeze roller pair which can prevent occurrence of spotted sensitization unevenness on a photosensitive material, and also provide a method for manufacturing a roller used in the automatic processing machine.

In order to achieve the above, in a first aspect of the present invention, there is provided an automatic processing machine in which an exposed photographic photosensitive material is subjected to development processing, comprising: a processing-solution processing section in which the photographic photosensitive material is subjected to development processing in such a manner as to be sequentially immersed in a developing solution filled in a developing tank, a fixing solution filled in a fixing tank, and washing water filled in a washing tank; a drying section in which the photographic photosensitive material processed in said processing-solution processing section is subjected to drying processing; and at least one conveying roller pair which is disposed at any one of a crossover portion between the developing tank and the fixing tank, and a position between the washing tank and said drying section, wherein a roller of the conveying roller pair, which comes into contact with a photosensitive emulsion surface of the photosensitive material, is structured in such a manner that a contact angle of a water drop on a peripheral surface of the roller is less than 135°.

According to the first aspect of the present invention, after development and washing processings, the contact angle of a water drop with respect to the peripheral surface of the roller of the conveying roller pair becomes smaller than 135°. The contact angle is more preferably less than 125°. When the contact angle becomes smaller, the surface tension of the water drop itself is weakened and water is dispersed over the roller peripheral surface. Accordingly, even when roller surfaces of the conveying roller pair are apt to be dried under the influence of the drying section disposed directly downstream of the conveying roller pair, adverse effects (spotted sensitization unevenness and the like) on a photosensitive material subsequently conveyed, which are caused by a concentration of components of a fixing solution contained in the water drops remaining on the roller peripheral surface, are remarkably alleviated.

In a second aspect of the present invention, in a surface treatment for a roller which comes into contact with an emulsion surface of the photosensitive material, the roller is immersed in an aqueous solution containing gelatin so that a surface thereof is coated with gelatin. At this time, it is most suitable that the roller is immersed in an aqueous solution containing 1 wt % of gelatin having a molecular weight of 20,000 to 300,000 and an average molecular weight of 100,000 so as to be coated with a gelatin film.

According to this aspect of the present invention, due to the roller being coated with the gelatin film, the contact angle of the water drop can be set at 125°. Therefore, the surface tension of the water drop is restrained and a so-called highly hydrophilic roller can be provided.

Here, even if the coating of a gelatin film is peeled off from the roller, as gelatin is solved out from photosensitive materials processed successively, a new film can be generated on the roller. As a result, the state in which the roller is coated with the gelatin film is constantly maintained.

In a third aspect of the present invention, the conveying roller pair is caused to run idle each time a predetermined amount of the photosensitive material is processed (for example, each time a sheet-like photosensitive material is processed), to allow water drops adhering to peripheral surfaces of rollers of the conveying roller pair to be uniformly dispersed over the entire peripheral surface of each of the rollers.

According to this aspect of the present invention, it is possible to completely prevent water drops from remaining as spot marks on the peripheral surface of the roller. As a result, spotted sensitization unevenness caused in the photosensitive material can be prevented and the quality of an image can be improved.

In a fourth aspect of the present invention, a roller including a peripheral surface of silicone rubber is subjected to primary cross-linking at 150° C. for one hour, and thereafter, it is further subjected to secondary cross-linking at 200° C. for 6 hours or more using silicon as a cross-linking material. When the secondary cross-linking time is made longer, rubber physical properties of the silicone rubber are stabilized. By conducting the secondary cross-linking for 10 hours or more (for example, 10 to 12 hours), swelling of the roller can be maintained at a low degree. It was confirmed that the contact angle of a water drop on the peripheral surface of the silicone rubber roller thus manufactured has been made smaller. Generally, when the cross-linking of silicone rubber is conducted using silicon, the cross-linking is usually conducted for 4 hours or thereabouts.

A fifth aspect of the present invention relates to a method for manufacturing a roller of a conveying roller pair, which comes into contact with a photosensitive emulsion surface of a photographic photosensitive material, the conveying roller pair being used in an automatic processing machine in which an exposed photographic photosensitive material is subjected to development processing in such a manner as to be immersed in a developing solution, a fixing solution, and washing water, and thereafter, is further subjected to drying processing in a drying section and the conveying roller pair being disposed at an upstream side of the drying section. The aforementioned method is characterized in that a silicone rubber roller containing, as a main component, a silicon polymer is used as the aforementioned roller, and the silicone rubber roller is subjected to primary cross-linking at 150° C. for one hour, and thereafter, is subjected to secondary cross-linking at 200° C. for 6 hours, preferably 10 hours.

As described above, there is a possibility that the formation of spot marks is caused by both a first cause (insufficient hydrophilic property) described in the above-described conventional art and a second cause (based on low molecular weight silicon volatilized toward the peripheral surface of the roller) found by further examination of the present inventors. Both cases result in the same phenomenon of formation of spot marks, but it is possible that the spot marks may be formed from the different two causes.

In order to deal with the first cause, as described in the first aspect, the degree of hydrophilicity of the peripheral surface of the roller is represented by a contact angle of a water drop, and a roller having a high hydrophilicity to make the contact angle to be less than a predetermined value is used. As a result, it is possible to prevent spot marks from being formed by the first cause.

On the other hand, in the second cause, so long as the cross-linking time is set as described in the fourth aspect, silicon does not volatilize toward the peripheral surface of the roller and the spot marks are not formed. Accordingly, the formation of spot marks by the second cause can be prevented.

In the present invention, in order to improve the hydrophilicity of the peripheral surface of the roller, an amount of low molecular weight silicon appearing as a residual cross-linking material, on the peripheral surface of the roller is decreased by prolonging the cross-linking time, and the contact angle of a water drop on the peripheral surface of the roller is made smaller. Namely, it should be noted that a measure to improve the hydrophilicity of the peripheral surface of a roller results in reduction of the amount of silicon volatilizing toward the peripheral surface of the roller.

BRIEF DESCRIPTION OF THE DRAWINGS

FIG. 2A shows the result when using a roller coated with gelatin, which is applied to the embodiment of the present invention; FIG. 2B shows the result when using a conventional silicone rubber roller; FIG. 2C shows the result when using a roller of which the silicone rubber surface has been subjected to rough finishing; and FIG. 2D shows the result when using a roller of which the silicone rubber surface is subjected to heat treatment.

DESCRIPTION OF THE PREFERRED EMBODIMENTS

First Embodiment

Figure 1:
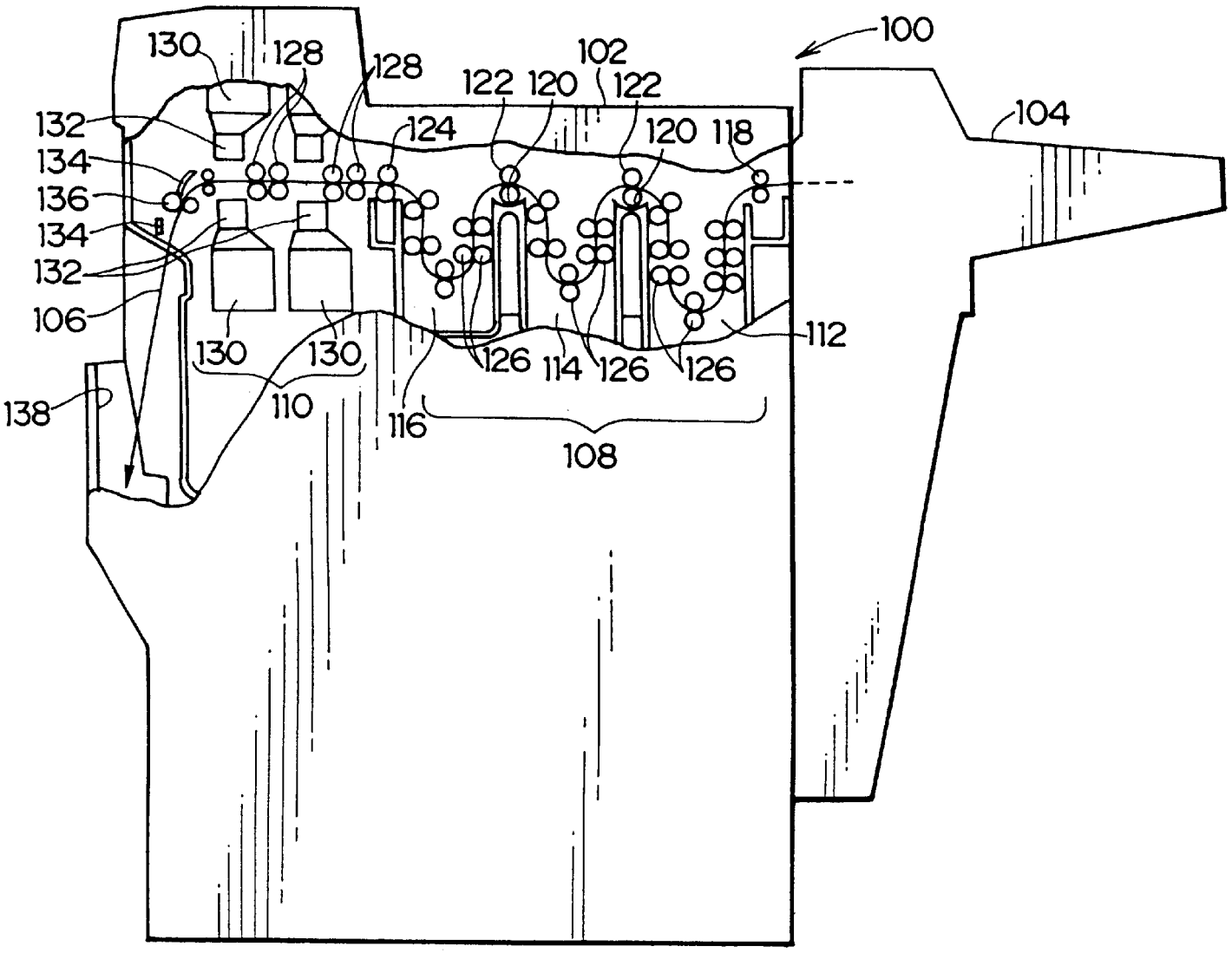
FIG. 1 is a schematic diagram of an automatic processing machine according to an embodiment of the present invention.
Figure 2A:
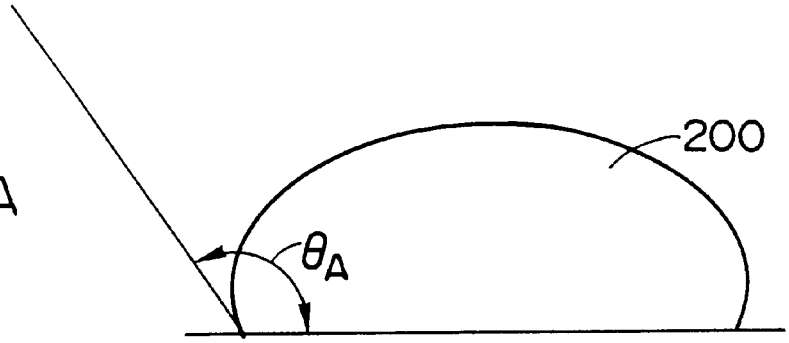
FIGS. 2A to 2D are diagrams each showing the experimental results of the contact angle of each water drop when different rollers are used.
Figure 2B:
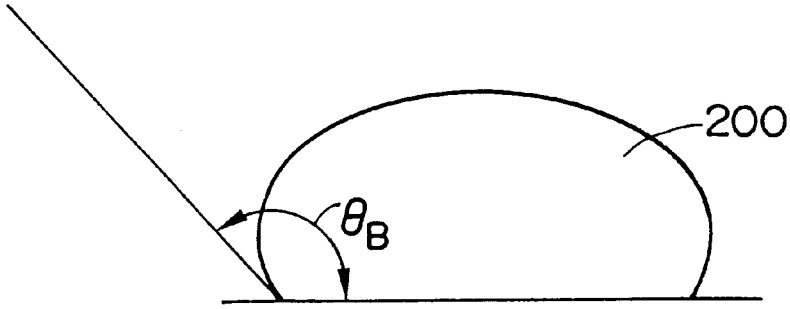
Figure 2C:
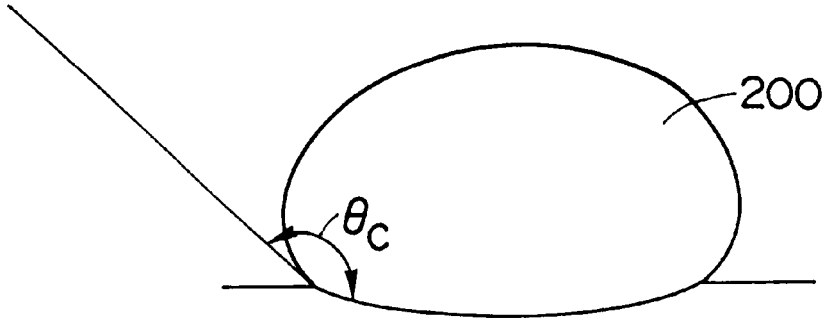
Figure 2D:
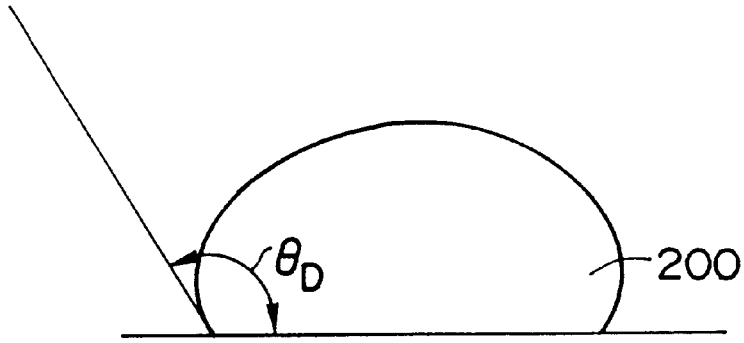

FIG. 1 shows an automatic processing machine 100 according to a first embodiment of the present invention.

The automatic processing machine 100 is equipped with an automatic feeder 104 at a side surface (on the right side in FIG. 1) of a main body 102 thereof. The automatic feeder 104 allows a plurality of photosensitive materials 106, on which images are recorded and which are set in an overlapping state, to be automatically conveyed into the main body 102 one by one. The automatic feeder 104 is provided to be removable from the main body 102 and a tray (not shown) serving as a guide supporting plate for conveying the photosensitive materials 106 into the main body 102 one by one in a manual manner may be mounted to the main body 102.

A processing-solution processing section 108 and a drying section 110 are disposed within the main body 102 in that order from the right side as shown in FIG. 1, and the photosensitive material 106 inserted from the automatic feeder 104 (or the tray) is first conveyed into the processing-solution processing section 108.

In the processing-solution processing section 108, a developing tank 112, a fixing tank 114, and a washing tank 116 are disposed in that order as shown in FIG. 1, and these tanks are formed in an integrated manner from synthetic resin.

In FIG. 1, insertion/guide rollers 118 for guiding the photosensitive material 106, which is to be subjected to development processing, to the developing tank 112 are provided in an upper right portion of the developing tank 112. Crossover rollers 122 are disposed between the developing tank 112 and the fixing tank 114 and between the fixing tank 114 and the washing tank 116 and each crossover roller is provided with a rinsing tank 120. Further, squeeze rollers 124 are disposed in an upper left portion of the washing tank 116 in FIG. 1, and convey the processed photosensitive material 106 from the washing tank 116 to the drying section 110, and further squeeze out water from the photosensitive material 106 which contains water from the washing tank 116.

In the squeeze rollers 124, a soft roller made of silicone rubber is used as an upper roller and a hard roller made of phenol is used as a lower roller.

The upper roller of the squeeze rollers 124 is coated with a gelatin film on a surface (peripheral surface) thereof to allow adjustment of a contact angle of a water drop 200 (see FIG. 2) adhering to the upper roller. The squeeze rollers 124 will be described later in detail.

A processing rack (not shown) is disposed in each of the developing tank 112, the fixing tank 114, and the washing tank 116, and is provided with a plurality of conveying roller pairs 126 which convey and guide the photosensitive material 106 substantially in a U-shaped manner in each of the tanks.

A plurality of conveying roller pairs 128 are disposed in the drying section 110 so as to convey and guide the photosensitive material 106 substantially in a horizontal direction, and drying fans 130 are disposed above and below the conveying roller pairs 128. Drying air generated by the drying fans 130 is heated by heaters 132 and is applied to the front and back surfaces of the photosensitive material 106 to dry the photosensitive material 106.

The photosensitive material 106 coming out of the drying section 110 is guided to a guide plate 134 and nipped by a discharging conveying roller pair 136, and is further discharged to a box-shaped stock portion 138.

Figure 3:
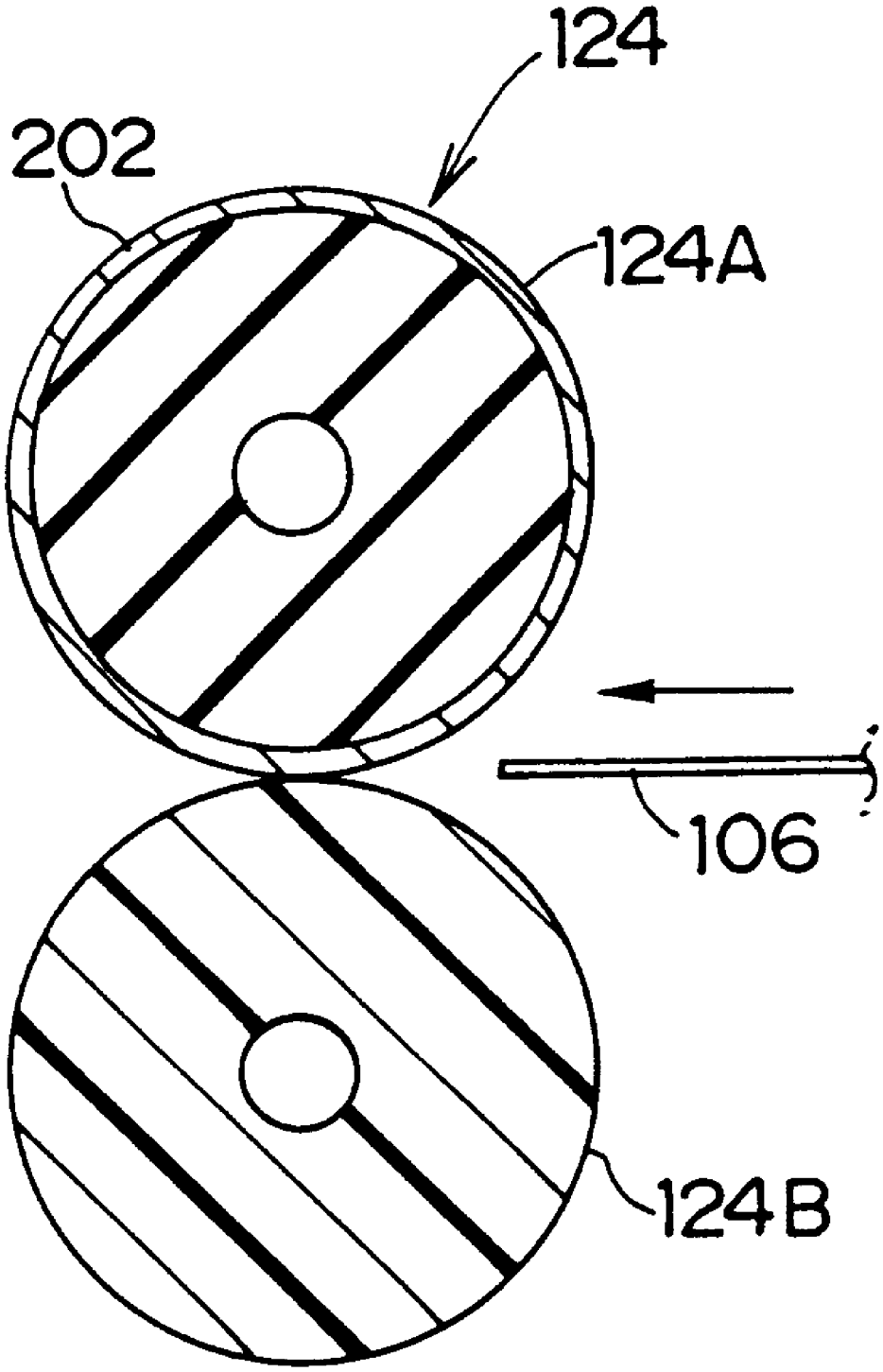
FIG. 3 is a cross-sectional view of squeeze rollers according to the embodiment of the present invention, taken along a line perpendicular to each axis of the squeeze rollers.

As shown in FIG. 3, an upper roller 124A of the squeeze rollers 124 is immersed in an aqueous solution containing 1 wt % of gelatin having a molecular weight of 20,000 to 300,000 and an average molecular weight of 100,000 prior to assembling, and is thereby coated with a gelatin film 202.

Due to the roller being coated with the gelatin film 202, a contact angle 0 of the water drop 200 is made smaller (to be 125°) than a case in which a roller having no gelatin film coating is used.

FIGS. 2A to 2D each show a result of measurement of the contact angle ($\theta_A$, $\theta_B$, $\theta_C$, and $\theta_D$ in FIGS. 2A to 2D) of the water drop 200 adhering to the surface of each of various rollers, that is, a roller coated with the gelatin film 202 (see FIG. 2A), a silicone rubber roller (see FIG. 2B), a silicone rubber roller whose surface has been subjected to rough finishing (see FIG. 2C), and a silicone rubber roller whose surface has been subjected to heat e treatment (see FIG. 2D), and the latter two rollers (in FIGS. 2C and 2D) are shown as comparative examples.

As a result, the respective contact angles $\theta_A$and $\theta_D$in the cases of using the roller coated with the gelatin film 202 and the roller subjected to heat treatment are each made smaller than the contact angles $\theta_B$ and $\theta_c$ of the water drop 200 observed on each peripheral surface of the conventional silicone rubber rollers. Among these rollers, in the present embodiment, the roller coated with the gelatin film 202 is selected.

When the contact angle $\theta_A$ becomes small (125°), the surface tension of the water drop 200 is lowered. Accordingly, the water drop 200 is not spherical and is apt to be formed in the shape of a low mountain. As a result, water adhering to the roller is uniformly dispersed over the entire surface of the roller.

Next, the operation of the first embodiment will be described.

When an operation is started in a state in which the photosensitive materials 106 are set in the automatic feeder 104, the uppermost one of the overlapping photosensitive materials 106 is taken out from the automatic feeder 104 by a suction member and is guided to the developing tank 112 while being nipped by the insertion/guide rollers 118. In the developing tank 112, the photosensitive material 106 is conveyed through the developing solution within the developing tank 112 along a substantially U-shaped path while being nipped by the plurality of conveying roller pairs 126, and is further conveyed to the surface of the developing solution. Subsequently, the photosensitive material 106 is nipped by the crossover rollers 122 and is guided to the fixing tank 114. In the fixing tank 114, the photosensitive material 106 is conveyed along a substantially U-shaped path while being nipped by the plurality of conveying roller pairs 126 in the same way as in the developing tank 112, and thereafter, the photosensitive material is nipped by the crossover rollers 122 and is guided to the washing tank 116. In the washing tank 16, the photosensitive material 106 is conveyed along a substantially U-shaped path while being nipped by the plurality of conveying roller pairs 126 and is further conveyed to the water surface. The photosensitive material 106 is then subjected to squeezing processing (that is, processing for squeezing out water from the photosensitive material 106 containing water) by the squeeze rollers 124, and thereafter, is conveyed to the drying section 110. In the drying section 110, the photosensitive material 106 is dried due to drying air heated at a predetermined temperature being blown onto the photosensitive material 106 while being conveyed in a horizontal direction, and is guided to the guide plate 134. Thereafter, the photosensitive material 106 is discharged to the box-shaped stock portion 138 while being nipped and conveyed by the discharging conveying roller pair 136.

Figure 4A:
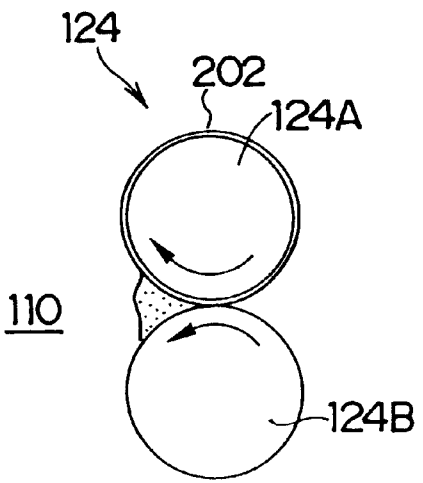
FIGS. 4A to 4D are operational diagrams which show a process from the time at which water is squeezed out from a photosensitive material by squeeze rollers to the time at which water drops are made flat.
Figure 4B:
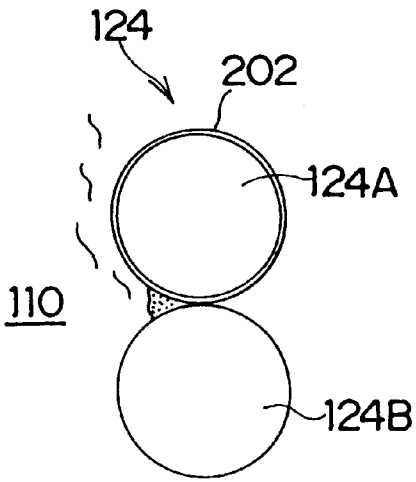

In the present embodiment, water squeezed out by the squeeze rollers 124 remains between the upper and lower rollers which form the squeeze rollers 124 (see FIG. 4A). This remaining water content substantially evaporates in a relatively short time for the reason that the squeeze rollers 124 are easily dried by the drying air used in the drying section 110 as compared with other rollers disposed outside the processing solutions (see FIG. 4B). Herein, the substantial evaporation of the water content means the evaporation of a so-called solvent ($H_2O$) other than fixing components (thiosulfate and the like) in the remaining water, and as a result, the fixing components are concentrated and left behind.

Figure 4C:
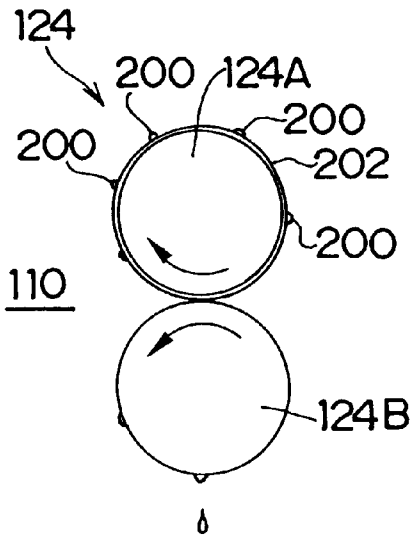

When subsequent photosensitive materials 106 are processed continuously with only a short time interval between processings, squeeze rollers 124 run idle, and therefore, dot-like concentrated water drops 200 adhere to the peripheral surface of the upper roller 124A (see FIG. 4C). Further, because of the structure of the squeeze roller 124 in which the lower roller 124B is a hard roller made from phenol, water drops 200 which have been transferred onto the lower roller 124B slip off the lower roller 124B and end up falling down to the washing tank 116. Accordingly, there is no possibility of the water drops 200 adhering to the lower roller 124B.

Almost all of the water can be removed due to the squeeze rollers 124 running idle, but the water drops 200 adhering to the upper roller 124A are left behind.

Conventionally, the upper roller 124A is designed so that the contact angle θ of the water drop 200 is 135°, and therefore, the shape of the water drop 200 is maintained until the subsequent photosensitive material 106 is conveyed, and thus the concentrated water drops 200 adhere to the photosensitive material 106 in a dotted state. Therefore, the photosensitive material 106 may be processed in such a manner that a portion of the photosensitive material 106 to which the concentrated water drops 200 adhere is sensitized to form spot marks.

Figure 4D:
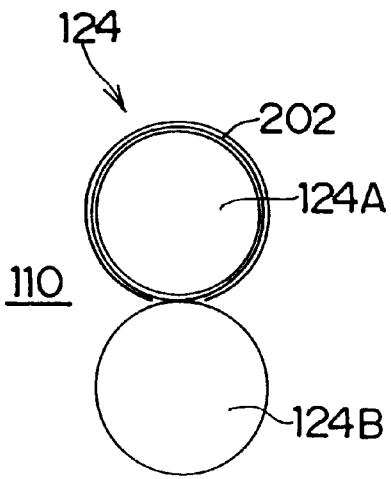

However, in the present embodiment, the surface of the upper roller 124A is coated with the gelatin film 202 so that the contact angle $\theta_A$ of the water drop 200 in the upper roller 124A becomes 125°, and therefore, the shape of the water drop 200 gradually disintegrates (that is, changes from a low mountain-like shape to a flat film-like shape) during the time by the subsequent photosensitive material 106 is conveyed to the roller. Namely, the water drops 200 are dispersed uniformly in the form of a film over the entire peripheral surface of the upper roller 124A, and therefore, formation of spot marks can be prevented (see FIG. 4D).

Meanwhile, even if the preformed gelatin film 202 is reduced, gelatin is eluted from the photosensitive material 106 while the photosensitive material 106 is being processed, and therefore, a new gelatin film 202 is formed each time the photosensitive material 106 is processed. Accordingly, an effect of preventing the formation of spot marks can be maintained semipermanently.

In the present embodiment, when the photosensitive materials 106 are processed at predetermined intervals, the water drops 200 are dispersed by causing the squeeze rollers 124 to run idle between the predetermined intervals. However, the time in which the squeeze rollers 124 are caused to run idle may be provided when the photosensitive material 106 is not being processed.

As described above, in the present embodiment, in the squeeze rollers 124 for squeezing out water from the photosensitive material 106 discharged from the washing tank 116, which are disposed nearest to the drying section 110, the upper roller 124A formed from a soft silicone rubber roller is coated with the gelatin film 202 so that the contact angle $\theta_A$ of the water drop 200; is 125°. Accordingly, the water drop 200 does not remain spherical and is easily made flat, and therefore, water is dispersed uniformly over the entire peripheral surface of the upper roller 124A and the formation of spot marks can be prevented.

Further, when the silicone rubber roller is manufactured, cross-linking is conducted by using silicon as a cross-linking material. It has been found that, when the cross-linking time is made longer (10 to 12 hours), low molecular weight silicon appearing on the surface of the roller can be restrained, thereby allowing the contact angle to become smaller. In a roller manufactured when the cross-linking is conducted for 4 hours, the contact angle is large and spot marks are formed. When a roller manufactured when the cross-linking is conducted for 10 to 12 hours is used, a satisfactory result can be obtained.

Namely, when cross-linking of silicone rubber is conducted using silicon as a cross-linking material, the cross-linking time is normally 4 hours or thereabouts. In this case, low molecular weight silicon appearing, as a residual cross-linking material, on the peripheral surface of the roller causes the contact angle of a water drop adhering to the peripheral surface of the roller to become larger. However, in the automatic processing machine according to the present invention, the time of cross-linking using silicon is set at 10 hours or more so as to solve problems caused by low molecular weight silicon appearing, as a residual cross-linking material, on the peripheral surface of the roller. As a result, the contact angle of the water drop on the peripheral surface of the roller can be made smaller.

Second Embodiment

Next, a second embodiment of the present invention will be described. It should be noted that the same portions as those of the first embodiment will be denoted by the same reference numerals, and a description thereof will be omitted. The second embodiment has a feature in a method for manufacturing the upper roller 124A of the squeeze rollers 124, and the overall structure and operation of the automatic processing machine 100 to which the squeeze rollers 124 are applied are the same as those of the first embodiment.

In the first embodiment, the upper roller 124A is formed so that the contact angle $\theta_A$ of the water drop 200 on the peripheral surface of the roller is at a predetermined value (125°). On the other hand, the second, embodiment relates to a method for manufacturing the roller 124A in itself, which is a silicone rubber roller.

Namely, the first and second embodiments have the same purposes of preventing formation of spot marks, but in the second embodiment, the cause of occurrence of spot marks is reconsidered from points of view different from the first embodiment.

As described above, in the first embodiment, it is recognized that the occurrence of spot marks and the hydrophilic properties of the peripheral surface of each of the squeeze rollers 124 correlate with each other (cause 1), and the peripheral surface of the roller is made hydrophilic (that is, the contact angle is made smaller) so as to completely prevent the occurrence of spot marks.

Further, in the first embodiment, the time for secondary cross-linking using silicon is made longer (usually, 4 hours or thereabouts) so as to make the surface of the roller hydrophilic.

On the other hand, in the second embodiment, it is considered that the occurrence of spot marks when a silicone rubber roller is used is caused because low molecular weight silicon present in a silicon polymer which is a main component of the squeeze roller 124 (silicone rubber roller) volatilizes toward the surface of the roller and is transferred to the photosensitive material 106 contacting the squeeze rollers 124, to thereby cause a phenomenon of sensitization on the photosensitive material 106 in which the transferred silicon serves as a core thereof (cause 2). Namely, in the present embodiment, the occurrence of spot marks is considered as a problem inherent in the silicone rubber roller which is frequently used as a squeeze roller, and a method for manufacturing a silicone rubber roller is provided in which volatilization of low molecular weight silicon toward the surface of roller, by which formation of spot marks is caused, can be prevented.

Accordingly, in the present embodiment, in order to solve the problem due to the aforementioned cause 2, silicone rubber to be used for the squeeze rollers 124 was subjected to primary cross-linking at 150° C. for one hour, and subsequently, subjected to secondary cross-linking at 200° C. for 10 hours. e The aforementioned cross-linking time has been experimentally determined by increasing the cross-linking time by units of fixed time from an ordinary cross-linking time (about 4 hours) to various cross-linking times.

That is, as the cross-linking time becomes longer, the degree of swelling of the silicone rubber roller for a fixing solution decreases. It was found that the effect of preventing the occurrence of spot marks first appears in 6 hours of cross-linking time and almost no change is shown in the cross-linking time exceeding 10 hours.

Further, when the cross-linking temperature is set at 215° C. or higher, deficient cross-linking is caused, and therefore, the secondary cross-linking was conducted at the temperature of 200° C.

As a result, not only is the low molecular weight silicon which causes formation of spot marks (cause 2) removed, but also chemical bonding of a silicon polymer and a filler is strengthened to increase a cross-linking density, thereby resulting in stabilization of rubber physical properties of the silicone rubber roller.

To summarize again, in the first embodiment, the roller is coated with the gelatin film 202, or when the silicone rubber roller is manufactured, cross-linking is conducted with silicon being used as a cross-linking material, so that a contact angle θ of the water drop 200 on the peripheral surface of the roller becomes a predetermined value. In the latter case, due to the cross-linking time being made longer (10 to 12 hours), the appearance of low molecular weight silicon on the peripheral surface of the roller can be restrained. As a result, the contact angle is made smaller (which is a solution of the problem based on the cause 1).

On the other hand, in the second embodiment, it is considered that the low molecular weight silicon appearing on (i.e., volatilizing toward) the surface of a silicon roller which is frequently used as a conveying roller or a squeeze roller directly causes formation of spot marks (cause 2), and a silicone rubber roller is prepared by primary cross-linking conducted at 150° C. for one hour and secondary cross-linking conducted at 200° C. for 10 hours so as to prevent volatilization of the low molecular weight silicon. Namely, it is not necessary that the resulting contact angle of the water drop 200 be considered.

As described above, the automatic processing machine according to the present invention has an excellent effect in that, when a photosensitive material is nipped and conveyed by a pair of rollers, spot-like sensitization unevenness on the photosensitive material, which is caused by water drops containing fixing components adhering to and concentrating on the rollers, and/or volatilization of low molecular silicon toward the surface of each roller, can be prevented.

What is claimed is:

1. An automatic processing machine in which an exposed photographic photosensitive material is subjected to development processing, comprising:

a processing-solution processing section in which the photographic photosensitive material is subjected to development processing in such a manner as to be sequentially immersed in a developing solution filled in a developing tank, a fixing solution filled in a fixing tank, and washing water filled in a washing tank;

a drying section in which the photographic photosensitive material processed in said processing-solution processing section is subjected to drying processing; and at least one conveying roller pair which is disposed at any one of a crossover portion between the developing tank and the fixing tank, and a position between the washing tank and said drying section, wherein a roller of said conveying roller pair, which comes into contact with a photosensitive emulsion surface of the photosensitive material, is structured so that a contact angle of a water drop on a peripheral surface of the roller is less than 135°.

2. An automatic processing machine according to claim 1, wherein the roller which comes into contact with the photosensitive emulsion surface of the photosensitive material is structured so that a contact angle of a water drop on a peripheral surface of the roller is less than 125°.

3. An automatic processing machine according to claim 1, wherein the roller which comes into contact with the photosensitive emulsion surface of the photosensitive material is immersed in an aqueous solution containing gelatin so that a surface thereof is coated with gelatin.

4. An automatic processing machine according to claim 1, further comprising a control device which causes said conveying roller pair to run idle each time a predetermined amount of the photosensitive material is processed, so as to allow water drops adhering to peripheral surfaces of rollers of said conveying roller pair to be uniformly dispersed over the entire peripheral surface of each of the rollers.

5. An automatic processing machine according to claim 1, further comprising a control device which causes said conveying roller pair to run idle at a previously-inputted predetermined timing, so as to allow water drops adhering to peripheral surfaces of rollers of said conveying roller pair to be uniformly dispersed over the entire peripheral surface of each of the rollers.

6. An automatic processing machine according to claim 1, wherein said conveying roller pair is a squeeze roller pair.

7. An automatic processing machine according to claim 6, wherein a roller of said squeeze roller pair, which comes into contact with the photosensitive emulsion surface of the photosensitive material, is structured so that a contact angle of a water drop on a peripheral surface of the roller is less than 125°.

8. An automatic processing machine according to claim 6, wherein a roller of. said squeeze roller pair, which comes into contact with a base surface of the photosensitive material, is a hard roller which contains phenol.

9. An automatic processing machine in which an exposed photographic photosensitive material is subjected to development processing, comprising:

a processing-solution processing section in which the photographic photosensitive material is subjected to development processing in such a manner as to be sequentially immersed in a developing solution filled in a developing tank, a fixing solution filled in a fixing tank, and washing water filled in a washing tank;

a drying section in which the photographic photosensitive material processed in said processing-solution processing section is subjected to drying processing; and at least one conveying roller pair which is disposed at any one of a crossover portion between the developing tank and the fixing tank, and a position between the washing tank and said drying section, wherein one of said conveying roller pair includes a peripheral surface of silicone rubber, manufactured by conducting primary cross-linking for one hour and secondary cross-linking for 6 hours or more, preferably 10 hours or more using silicon as a cross-linking material.

10. An automatic processing machine according to claim 9, further comprising a control device which causes said conveying roller pair to run idle at a previously-inputted predetermined timing, so as to allow water drops adhering to peripheral surfaces of rollers of said conveying roller pair to be uniformly dispersed over the entire peripheral surface of each of the rollers.

11. An automatic processing machine according to claim 9, further comprising a control device which causes the roller of said conveying roller pair to run idle at a previously-inputted predetermined timing, so as to allow water drops to be uniformly dispersed over the entire peripheral surface of the roller.

12. An automatic processing machine according to claim 9, wherein said conveying roller pair is a squeeze roller pair.

13. An automatic processing machine according to claim 12, wherein a roller of said squeeze roller pair, which comes into contact with the photosensitive emulsion surface of the photosensitive material, is structured so that a contact angle of a water drop on a peripheral surface of the roller is less than 125°.

14. An automatic processing machine according to claim 12, wherein a roller of said squeeze roller pair, which comes into contact with a base surface of the photosensitive material, is a hard roller which contains phenol.

15. A method for manufacturing a roller of a conveying pair, which roller comes into contact with a photosensitive emulsion surface of a photographic photosensitive material, in the automatic processing machine of claim 1, said method comprising the steps of:

conducting primary cross-linking for a silicone rubber roller containing, as a main component, a silicon polymer at 150° C. for one hour; and conducting secondary cross-linking for the silicone rubber roller subjected to the primary cross-linking at 200° C. for 6 hours, preferably 10 hours.

16. An automatic processing machine in which an exposed photographic photosensitive material is subjected to development processing, comprising:

processing-solution processing section in which the photographic photosensitive material is subjected to development processing in such a manner as to be sequentially immersed in a developing solution filled in a developing tank, a fixing solution filled in a fixing tank, and washing water filled in a washing tank;

a drying section in which the photographic photosensitive material processed in said processing-solution is subjected to drying processing; and at least one means for nipping and guiding the photosensitive material, disposed unsubmerged at any one of a crossover portion between the developing tank and the fixing tank, and between the washing tank and the drying section, wherein a contact angle of a water drop on a surface of the nipping and guiding means in contact with a photographic emulsion surface of the photographic photosensitive surface is less than 135°.

* * * * *